US006227919B1

(12) United States Patent
Blanchard

(10) Patent No.: US 6,227,919 B1
(45) Date of Patent: May 8, 2001

(54) WATER JET PROPULSION UNIT WITH MEANS FOR PROVIDING LATERAL THRUST

(75) Inventor: Clarence E. Blanchard, Pleasant Prairie, WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/524,365

(22) Filed: Mar. 14, 2000

(51) Int. Cl.[7] ..... B63H 11/113
(52) U.S. Cl. ..... 440/42
(58) Field of Search ..... 440/38, 40–42, 440/47

(56) References Cited

U.S. PATENT DOCUMENTS

| | | | | |
|---|---|---|---|---|
| 3,030,909 | | 4/1962 | Barnes | 115/12 |
| 3,258,916 | | 7/1966 | Lehman | 60/35.55 |
| 3,842,787 | * | 10/1974 | Giacosa | 440/42 |
| 3,937,172 | | 2/1976 | Castoldi | 115/12 R |
| 4,031,844 | | 6/1977 | Onal | 115/12 R |
| 4,252,075 | | 2/1981 | Kobayashi | 440/42 |

* cited by examiner

*Primary Examiner*—Ed Swinehart
(74) *Attorney, Agent, or Firm*—Dennis M. Flaherty

(57) ABSTRACT

A water jet apparatus having a mechanism for providing additional lateral thrust when a boat is moving in reverse. A steering nozzle is pivotably mounted at and in flow communication with the outlet of a flow-through housing, and has a pair of opposing side thrust nozzles. The water flow exiting the steering nozzle is reversed by a reverse gate which covers the main outlet of the steering nozzle and by a reverse nozzle incorporated as part of the steering nozzle. The reversed flow exits the steering nozzle via the reverse nozzle, which directs the reversed flow forward and downward. When the steering nozzle is turned a predetermined angle to one side in reverse, the side thrust nozzle on the opposing side is swung into the path of water flow exiting the housing outlet. In this position, the side thrust nozzle directs a portion of the flow exiting the housing outlet in a direction approximately at a right angle relative to the centerline of the turned steering nozzle to provide additional lateral thrust directed toward the one side.

21 Claims, 3 Drawing Sheets

WATER JET PROPULSION UNIT WITH MEANS FOR PROVIDING LATERAL THRUST

FIELD OF THE INVENTION

This invention generally relates to water jet apparatus for propelling boats and other watercraft. In particular, the invention relates to mechanisms for shifting a water jet apparatus to selectively propel a craft in the forward or reverse direction.

BACKGROUND OF THE INVENTION

It is known to propel a boat or other watercraft using a water jet apparatus mounted to the hull, with the powerhead being placed inside (inboard) the hull. The drive shaft of the water jet apparatus is coupled to the output shaft of the inboard motor. The impeller is mounted on the drive shaft and installed in a housing, the interior surface of which defines a water tunnel. The impeller is designed such that during motor operation, the rotating impeller impels water rearward through the water tunnel. The reaction force propels the boat forward.

In addition, it is known to provide a mechanism for diverting the exiting water flow to one side or the other of a water jet mid-plane, thereby enabling the boat operator to steer the boat to the left or right during forward propulsion. One such mechanism is a steering nozzle pivotably mounted to the housing and in flow communication with the housing outlet. Preferably the pivot axis of the steering nozzle lies in the water jet mid-plane. As the steering nozzle is pivoted to the left of a central position, the water flow out of the housing is diverted leftward, producing a reaction force which pushes the water jet apparatus and the boat stern to the right, thereby causing the bow of the boat to turn to the left. Similarly, the boat bow turns to the right when the steering nozzle is pivoted to the right of the central position.

It is also known to provide a mechanism for reversing the direction of the water flow exiting the steering nozzle. The reverse gate can be pivotably mounted to the steering nozzle, its pivot axis being generally perpendicular to the pivot axis of the steering nozzle. In the up position, the reverse gate is clear of the water flow exiting the steering nozzle. In the down position, the reverse gate is disposed in the path of the exiting water flow. In its simplest embodiment, the reverse gate has a U-shaped channel which reverses the water flow exiting the steering nozzle. When the steering nozzle is turned to the left, the resulting water flow having rearward and leftward velocity components is redirected by the reverse gate to have forward and rightward components. This produces a reaction force which pulls the boat rearward and propels the water jet apparatus and boat stern to the left, causing the boat to turn left during rearward movement. Similarly, the boat turns to the right during rearward movement when the steering nozzle is turned to the right. The provision of a steerable reverse gate allows the boat operator to steer in forward and reverse in the same manner that an automobile can be steered.

A conventional reverse gate mounted to the steering nozzle does not provide enhanced control and maneuverability of a boat in reverse. In particular, there is a need for an arrangement whereby additional lateral thrust can be applied during reverse motion of a boat.

SUMMARY OF THE INVENTION

The present invention is directed to a water jet apparatus having means for providing additional lateral thrust when a boat is moving in reverse. In accordance with the preferred embodiment, a water jet propulsion unit comprises a steering nozzle pivotably mounted at and in flow communication with the outlet of a flow-through housing, and having a pair of opposing side thrust nozzles. The preferred embodiment further comprises means for reversing the water flow exiting the steering nozzle. For example, the reversing means may comprise a reverse gate for covering the outlet of the steering nozzle and a reverse nozzle incorporated as part of the steering nozzle. The reversed flow exits the steering nozzle via the reverse nozzle.

In accordance with the preferred embodiment of the invention, when the steering nozzle is turned a predetermined angle, e.g., 30 degrees, to one side, the side thrust nozzle on the opposing side is swung into the path of water flow exiting the housing outlet. In this position, the side thrust nozzle directs a portion of the flow exiting the housing outlet in a direction approximately at a right angle relative to the centerline of the turned steering nozzle. This provides a lateral thrust directed toward the one side. In addition, when the reverse gate is lowered into a position where the reverse gate closes the steering nozzle outlet, the flow inside the steering nozzle is reversed. Some portion of the reversed flow then exits the steering nozzle via the reverse nozzle, causing a thrust for pulling the boat in a direction collinear with the centerline of the turned steering nozzle, i.e., the thrust vector has a reverse thrust component and a lateral thrust component, the latter also being in the direction toward the one side.

In accordance with the preferred embodiment of the invention, the left side thrust nozzle provides a rightward lateral thrust, in addition to the rightward lateral thrust provided by the reverse gate and reverse nozzle, when the steering nozzle is turned to the right by a predetermined angle. Similarly, the right side thrust nozzle will provide a leftward lateral thrust, in addition to the leftward lateral thrust provided by the reverse gate and reverse nozzle, when the steering nozzle is turned to the left by a predetermined angle. The reverse gate is pivotable between open and closed positions. In the open position, the reverse gate is clear of the flow exiting the steering nozzle. With the reverse gate in the open position and the steering nozzle in a central position, i.e., symmetrically disposed relative to a mid-plane of the water jet housing, the exit flow is rearward during water jet operation and the boat is propelled forward. In the closed position, the reverse gate obstructs the flow in the steering nozzle and changes the rearward directional flow component into a predominantly forward directional flow component, which exits the steering nozzle via the reverse nozzle. If the steering nozzle is in the central position, then the forward flow out of the reverse nozzle propels the boat rearward along a straight line. Alternatively, if the steering nozzle is in an off-center position, then the boat is propelled along an arcuate path, i.e., the boat will turn. Whether the boat is being propelled forward or rearward, turning the steering nozzle to the right of the mid-plane causes the boat to turn right; turning the steering nozzle to the left of the mid-plane causes the boat to turn left. However, the side thrust nozzles on the steering nozzle provide increased lateral thrust when the boat is in reverse and the steering nozzle is turned to a pre-determined angle. The result is enhanced control and maneuverability when the boat is in reverse.

DETAILED DESCRIPTION OF THE PREFERRED EMBODIMENTS

Figure 1:
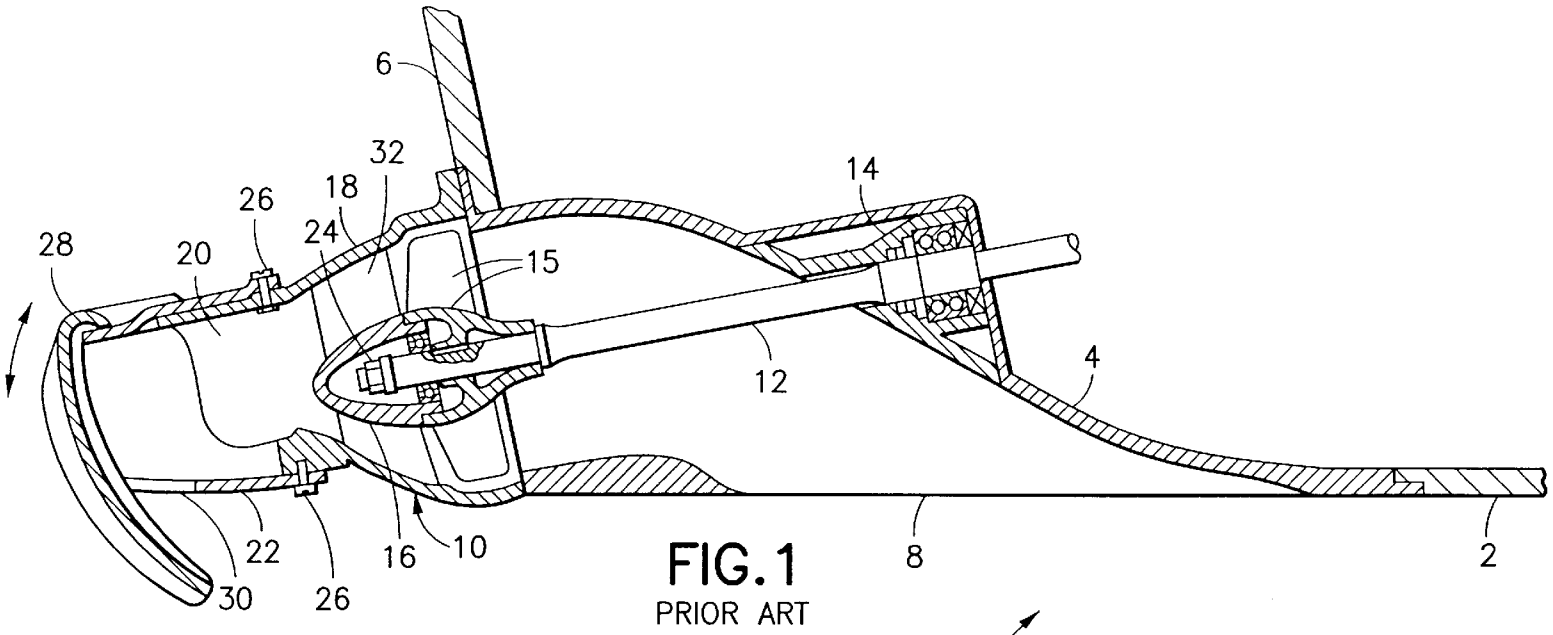
FIG.1 PRIOR ART
FIG. 1 is a schematic showing an elevational sectional view of a conventional water jet propulsion system.

FIG. 1 depicts a conventional water jet apparatus mounted to a boat. The boat has a hull 2 with a water tunnel 4 installed in its stern. The water tunnel 4 has a height which gradually increases from its starting point to a maximum height located at the transom 6 of the hull. The water tunnel 4 is installed in an opening in the hull. The intake 8 of the water tunnel 4 lies generally in the plane of the bottom of hull 2 while the outlet of the water tunnel 4 lies generally in the plane of the transom.

In addition, the boat partially depicted in FIG. 1 comprises an outboard water jet propulsion unit 10 having an inlet which is in flow communication with the outlet of the water tunnel 4. The water jet propulsion unit 10 is powered by an inboard engine (not shown) by means of a drive shaft 12. The drive shaft 12 is rotatably mounted in a conventional fashion, e.g., by a first set of bearings installed in the bearing housing 14 and by a second set of bearings installed in a stator hub 16 of the water jet propulsion unit 10.

An impeller 15 comprising a hub and a plurality of blades is mounted near the end of the drive shaft 12. The hub and blades of impeller 15 are preferably integrally formed as one cast piece. As indicated by the cutaway portion of the drive shaft 12 seen in FIG. 1, the hub of impeller 15 and the drive shaft 12 are keyed so that the impeller will rotate in unison with the driveshaft. Alternatively, the impeller hub can be provided with a splined bore which meshes with splines formed on the external surface of the drive shaft. The impeller 15 is held securely on the drive shaft 12 by a lock nut 24 tightened onto a threaded end of the drive shaft 12. As seen in FIG. 1, the hub of the impeller 15 increases in radius in the aft direction, transitioning gradually from a generally conical outer surface at the leading edge of the impeller hub to a generally circular cylindrical outer surface at the trailing edge of the impeller hub. This outer surface of the impeller hub forms the radially inner boundary for guiding the flow of water impelled by the impeller.

The water jet propulsion unit shown in FIG. 1 also comprises a stator housing 18 which surrounds the impeller blades. The inner surface of the stator housing 18 forms the radially outer boundary for guiding the flow of water impelled by the impeller. The stator housing 18 has an inlet in flow communication with the outlet of the water tunnel 4. The stator housing 18 is connected to the stator hub 16 by a plurality of stator vanes 32. The stator hub 16 gradually decreases in radius in the aft direction to form a cone, starting out at a radius slightly less than the radius at the trailing edge of the impeller hub. The stator vanes 32 are designed to redirect the swirling flow out of the impeller 15 into non-swirling flow.

The unit shown in FIG. 1 further comprises an exit nozzle 20 having an inlet in flow communication with the outlet of the stator housing 18. The water exits the water jet propulsion unit via a steering nozzle 22, which is in flow communication with the exit nozzle 20 and can change the direction of the water exiting the exit nozzle. The steering nozzle 22 is pivotably mounted to the exit nozzle 20 by a pair of pivot assemblies 26 located at the top and bottom of the exit nozzle. For example, each pivot assembly may comprise a screw, a sleeve and a bushing. The axes of the screws are collinear and form a vertical pivot axis about which the steering nozzle 22 can swing from left to right and vice versa to steer the boat. The water flow exiting the steering nozzle 22 can be reversed by activation of a reverse gate 22, which causes exiting water to flow through a slot 30 formed in the steering nozzle 22 and in a reverse direction. The steering and shifting controls for controlling the positions of the steering nozzle and the reverse gate comprise well-known structures such as cables, links and levers, the bulk of which are not shown to avoid unnecessary complication of the drawings.

Figure 2:
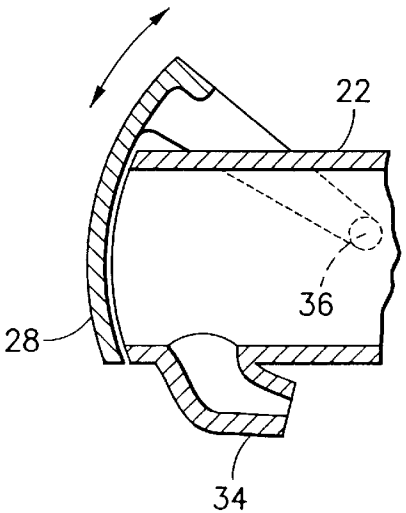
FIG.2 PRIOR ART
FIG. 2 is a schematic showing a partial elevational sectional view of another conventional water jet propulsion system.

FIG. 2 shows another prior art construction wherein a forwardly opening reverse nozzle 34 is installed on the lower part of the steering nozzle near the outlet of the latter. A reverse gate 28 is rotatably mounted on a pair of pivot assemblies 36 (only one of which is depicted in FIG. 2) having a horizontal axis generally perpendicular to the axis of the steering nozzle pivot assemblies (not shown).

In the prior art constructions depicted in FIGS. 1 and 2, any lateral steering thrust is provided solely by the lateral component of the reversed flow through slot 30 (FIG. 1) or nozzle 34 (FIG. 2). No means are disclosed for providing additional lateral thrust for enhanced steering in reverse.

Figure 3:
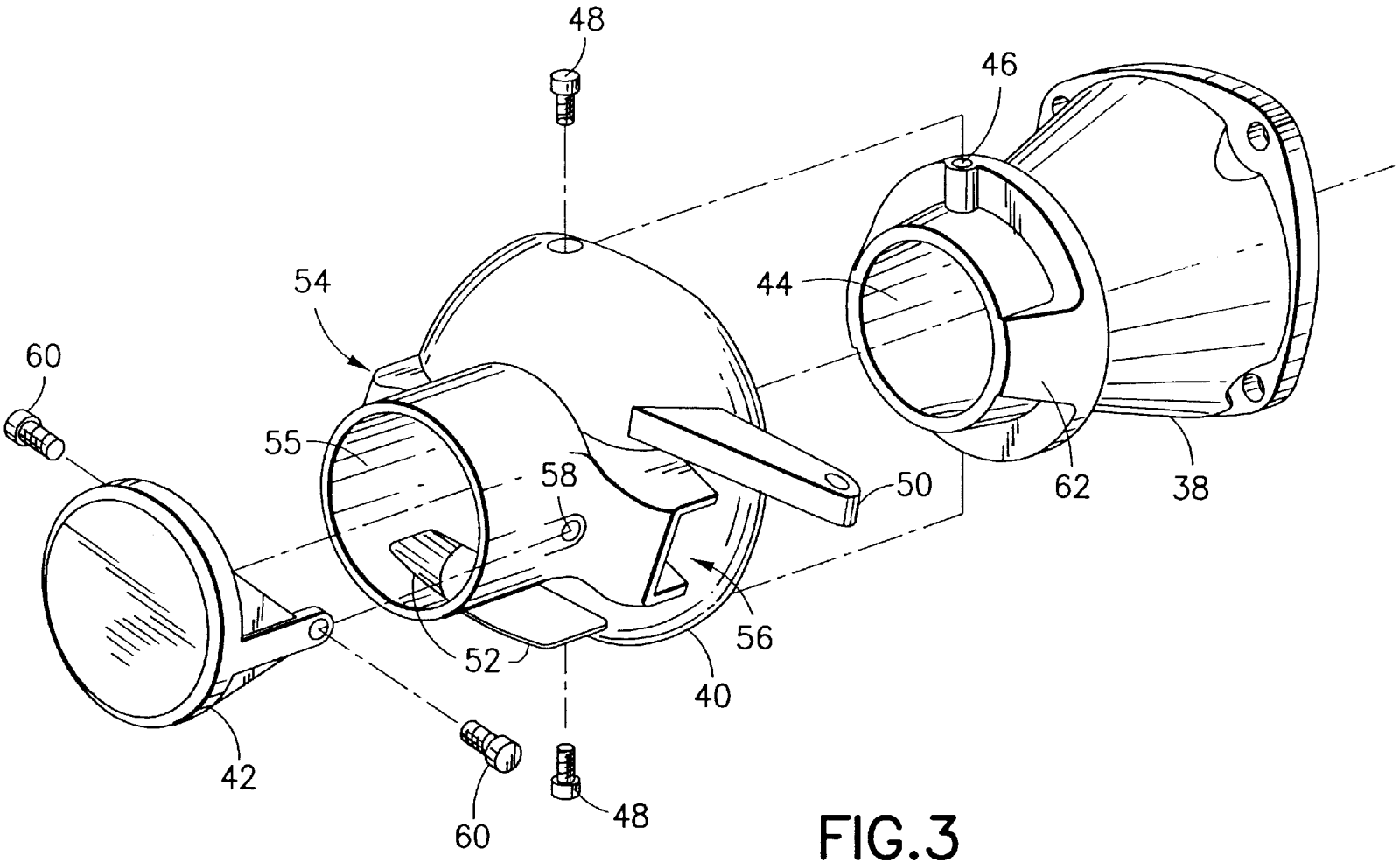
FIG. 3 is a schematic showing an exploded isometric view of parts of a water jet propulsion system in accordance with a preferred embodiment of the invention.
Figure 5:
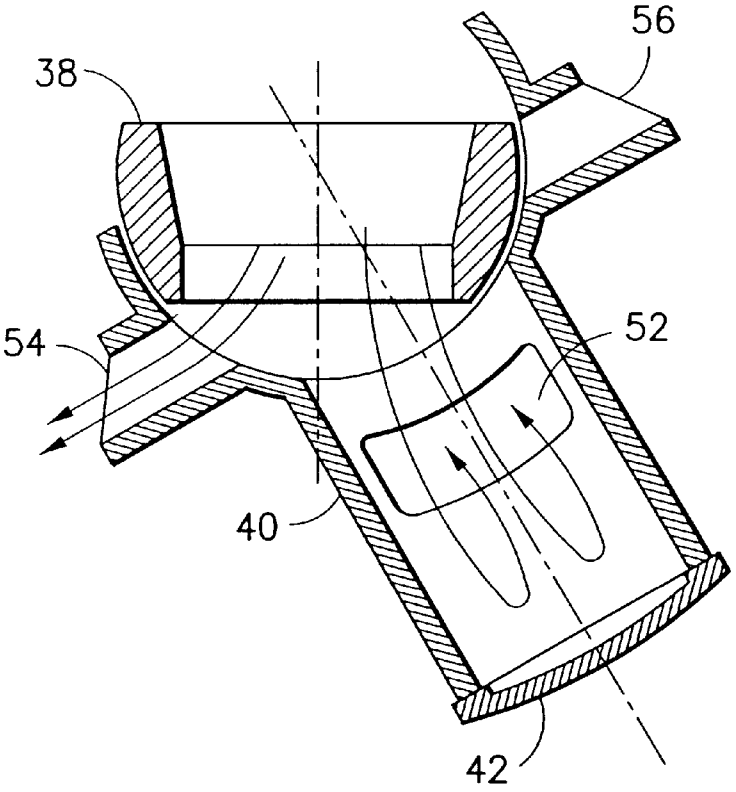
FIGS. 4 and 5 are schematics showing partial sectional views of parts of a water jet propulsion system in accordance with the preferred embodiment, FIG. 4 showing the steering nozzle aligned with the outlet nozzle, and FIG. 5 showing the steering nozzle turned 30 degrees to the right relative to the centerline of the outlet nozzle.
Figure 4:
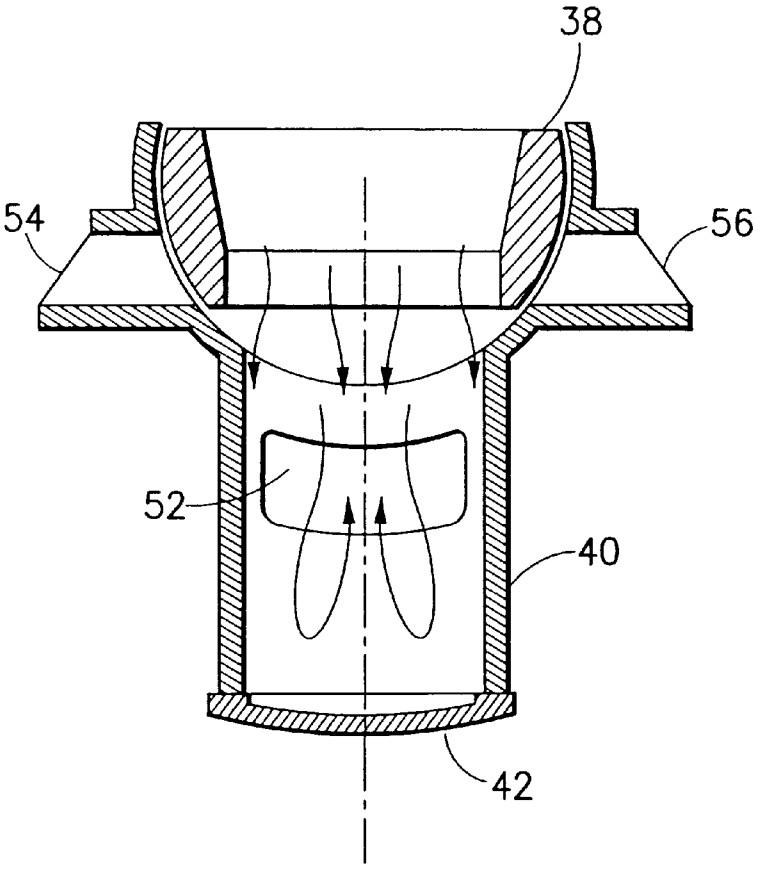

The preferred embodiment of the present invention is depicted in FIGS. 3–5. For the sake of simplicity, only relevant parts of the water jet propulsion unit are shown, namely, an exit nozzle 38, a steering nozzle 40 and a reverse gate 42. The person skilled in the art will recognize that the exit nozzle is mounted to a stator housing or impeller duct not shown in FIGS. 3 and 5. Furthermore, it should be appreciated that the assembled exit nozzle, steering nozzle and reverse gate can be incorporated in any type of water jet propulsion unit, including, but not limited to, water jet propulsion units driven by outboard motors or inboard motors.

Referring to FIG. 3, the water jet propulsion unit in accordance with the preferred embodiment comprises an exit nozzle 38 having an outlet 44 and a pair of recesses 46 (only one of which is visible in FIG. 3) for receiving respective pivot pins 48. A steering nozzle 40 is pivotably mounted to the exit nozzle 38 by means of the pivot pins 48 which, as previously described, have collinear vertical centerlines for allowing the steering nozzle to swing from side to side for steering the boat. The steering nozzle 40 has a steering arm 50 which is ultimately coupled to a steering wheel in the cockpit by means of any conventional arrangement of levers, links and cables. The steering nozzle also comprises a reverse nozzle 52 which is in flow communication with a reverse slot or port formed in the wall of the main channel of the steering nozzle and which serves the function of directing reversed flow in the forward direction as it exits the steering nozzle. In accordance with the preferred embodiment of the invention, the steering nozzle further comprises a pair of side thrust nozzles 54 and 56, the functionality of which will be described in detail hereinafter with reference to FIGS. 4 and 5. The steering nozzle 40 also has an outlet 56 and a pair of recesses 58 (only one of which is visible in FIG. 3) for receiving respective pivot pins 60. A reverse gate 42 is pivotably mounted to the steering nozzle 40 by means of the pivot pins 60 which, as previously described, have collinear horizontal centerlines for allowing the reverse gate to swing between up (open) and down (closed) positions. Preferably the axes of rotation of the steering nozzle and of the reverse gate are generally mutually perpendicular.

The reverse gate 42 is shown in the down position in FIGS. 4 and 5. When the centerline of the steering nozzle 40 is collinear with the centerline of the exit nozzle and the reverse gate is in the down position as shown in FIG. 4, the reverse gate 42 covers the outlet of the steering nozzle 40, causing rearward flow in the steering nozzle to reverse and escape out the reverse nozzle 52. The side thrust nozzles 54 and 56 are normally closed by a shut-off area 62 on each side of the exit nozzle outlet. The escape of fluid out through the side thrust nozzles 54 and 56 is insignificant when the steering nozzle is not turned. Moreover, to the extent that fluid escapes through both side thrust nozzles, any lateral thrust produced by the flow through one port will be substantially countered by the lateral thrust produced by flow through the other port. Thus, during operation of the water jet propulsion unit with the steering nozzle and reverse gate positioned as shown in FIG. 4, the propulsion unit will pull the boat straight backwards. On the other hand, when the reverse gate is lifted, the steering nozzle outlet is opened. The water exiting the exit nozzle will flow rearwardly through the steering nozzle, passing over the reverse nozzle. When that rearwardly flowing fluid exits the steering nozzle, a thrust propelling the boat forward will be produced.

In accordance with the preferred embodiment of the invention, as the steering nozzle is turned to the right with the reverse gate down, the reversed flow exiting the reverse nozzle will have leftward and forward velocity components. The leftward velocity component will produce a lateral thrust which tends to propel the hull stern rightward as the boat moves in reverse. As shown in FIG. 5, when the steering nozzle 40 has been turned to the right a predetermined angle, e.g., 30 degrees, the left side thrust nozzle 54 is displaced into the path of fluid exiting the exit nozzle 38. Preferably, the centerline of the side thrust nozzles 54 and 56 is generally perpendicular to the centerline of the steering nozzle. Therefore, when the steering nozzle is turned 30 degrees, as seen in FIG. 5, the left side thrust nozzle 54 diverts some portion of the flow exiting the exit nozzle by an angle of about 60 degrees. The diverted flow exiting the left side thrust nozzle 54 will have leftward and rearward velocity components. The diverted leftward velocity component produces additional lateral thrust tending to propel the hull stern rightward as the boat moves in reverse. Similarly, when the steering nozzle is turned to the left by 30 degrees (not shown), the right side thrust nozzle 56 diverts some portion of the flow exiting the exit nozzle by an angle of about 60 degrees. The diverted flow exiting the right side thrust nozzle 56 will have rightward and rearward velocity components. The diverted rightward velocity component produces additional lateral thrust tending to propel the hull stern leftward as the boat moves in reverse. The end result is that the invention provides enhanced control and maneuverability when the boat is moved in reverse.

The relative sizes of the steering nozzle and the side thrust nozzle are designed so that the forward thrust produced by the rearward velocity component of the flow diverted through the side thrust nozzle is less than the rearward thrust produced by the forward velocity component of the reversed flow passing out the reverse nozzle 52. In particular, the reverse nozzle of the steering nozzle has a cross-sectional area greater than the cross-sectional area of each side thrust nozzle.

In accordance with alternative preferred embodiments, each side of the steering nozzle may be provided with a side thrust wall adjacent the side thrust port instead of a side thrust nozzle. In other words, it is not necessary for the water exiting the side thrust port to flow along an enclosed nozzle, pipe or tube, but rather any means may be used which diverts flow entering the side thrust port to the side of the steering nozzle. The diverting wall can be planar or curved.

While the invention has been described with reference to preferred embodiments, it will be understood by those skilled in the art that various changes may be made and equivalents may be substituted for elements thereof without departing from the scope of the invention. For example, the side thrust nozzles need not be straight. Furthermore, if straight side thrust nozzles are used, they need not be directed at right angles to the centerline of the steering nozzle. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "housing" comprises one or more attached parts. For example, in the disclosed preferred embodiment, the housing may comprise a water tunnel, a stator housing or impeller duct, and an exit nozzle. However, the present invention encompasses forming the water tunnel and stator housing as one piece, forming the stator housing and the exit nozzle as one piece, forming the inlet housing as two pieces, forming the stator housing as two pieces, and so forth. All such variations fall within the meaning of "housing" as that term is used in the claims.

I claim:

1. A water jet apparatus comprising:

a flow-through housing;

a steering nozzle pivotably mounted to and in flow communication with said housing, said steering nozzle being pivotable between first and second steering positions and comprising an outlet, a reverse port upstream of said outlet, and first and second side ports upstream of said reverse port on opposing sides of said steering nozzle; and a reverse gate pivotable between first and second shift positions, said reverse gate in said first shift position being removed from the path of water flowing toward said steering nozzle outlet and in said second shift position being in the path of water flowing toward said steering nozzle outlet.

2. The water jet apparatus as recited in claim 1, wherein said steering nozzle further comprises first and second side thrust nozzles in flow communication with said first and second side ports respectively.

3. The water jet apparatus as recited in claim 2, wherein each of said first and second side thrust nozzles is substantially straight.

4. The water jet apparatus as recited in claim 3, wherein each of said first and second side thrust nozzles is substantially perpendicular to a mid-plane of said steering nozzle.

5. The water jet apparatus as recited in claim 1, wherein said steering nozzle further comprises first means for deflecting a first stream of fluid to one side of and away from a mid-plane of said steering nozzle after said first stream of fluid has passed through said first side port when said steering nozzle is in said first steering position, and second means for deflecting a second stream of fluid to another side of and away from said mid-plane of said steering nozzle after said second stream of fluid has passed through said second side port when said steering nozzle is in said second steering position.

6. The water jet apparatus as recited in claim 1, wherein said first side port is not covered and said second side port is covered when said steering nozzle is in said first steering position, and said first side port is covered and said second side port is not covered when said steering nozzle is in said second steering position.

7. The water jet apparatus as recited in claim 5, wherein said first deflecting means comprises a first nozzle in flow communication with said first side port and said second deflecting means comprises a second nozzle in flow communication with said second side port.

8. The water jet apparatus as recited in claim 1, wherein said steering nozzle further comprises a reverse nozzle in flow communication with said reverse port.

9. The water jet apparatus as recited in claim 1, wherein said reverse port has a cross-sectional area greater than the cross-sectional area of either of said side ports.

10. The water jet apparatus as recited in claim 1, wherein said steering nozzle is pivotable about a first pivot axis and said reverse gate is pivotable about a second pivot axis substantially perpendicular to said first axis.

11. A water jet propulsion unit comprising:

a housing comprising an inlet and an outlet;

an impeller rotatably mounted within said housing;

a steering nozzle pivotably mounted to said housing for receiving flow from said housing outlet, said steering nozzle being pivotable between first and second steering positions and comprising an outlet and first and second side ports on opposing sides of said steering nozzle, each of said first and second side ports being closed by said housing when said steering nozzle is in a central position; and a gate pivotable between first and second shift positions, said gate in said first shift position being removed from the path of water flowing toward said steering nozzle outlet and in said second shift position being in the path of water flowing toward said steering nozzle outlet.

12. The water jet apparatus as recited in claim 11, wherein said steering nozzle further comprises first and second side thrust nozzles in flow communication with said first and second side ports respectively.

13. The water jet apparatus as recited in claim 11, wherein said steering nozzle further comprises first means for deflecting a first stream of fluid to one side of and away from a mid-plane of said steering nozzle after said first stream of fluid has passed through said first side port when said steering nozzle is in said first steering position, and second means for deflecting a second stream of fluid to another side of and away from said mid-plane of said steering nozzle after said second stream of fluid has passed through said second side port when said steering nozzle is in said second steering position.

14. The water jet apparatus as recited in claim 11, wherein said first side port is not covered and said second side port is covered when said steering nozzle is in said first steering position, and said first side port is covered and said second side port is not covered when said steering nozzle is in said second steering position.

15. The water jet apparatus as recited in claim 13, wherein said first deflecting means comprises a first nozzle in flow communication with said first side port and said second deflecting means comprises a second nozzle in flow communication with said second side port.

16. A water jet apparatus comprising:

a housing comprising an inlet and an outlet;

an impeller rotatable mounted within said housing;

a steering nozzle pivotably mounted to said housing for receiving flow from said housing outlet, said steering nozzle being pivotable between first and second steering positions and comprising an outlet, first and second side ports on opposing sides of said steering nozzle, and a reverse port located downstream of said side ports; and a gate pivotable between first and second shift positions, said gate in said first shift position being removed from the path of water flowing toward said steering nozzle outlet and in said second shift position being in the path of water flowing toward said steering nozzle outlet.

17. The water jet apparatus as recited in claim 16, wherein said steering nozzle further comprises a reverse nozzle in flow communication with said reverse port.

18. The water jet apparatus as recited in claim 16, wherein said reverse port has a cross-sectional area greater than the cross-sectional area of either of said side ports.

19. A steering device comprising a steering nozzle which comprises first and second pivot means having a pivot axis lying in a mid-plane of said steering nozzle, an outlet remote from said pivot axis, first and second side ports located on opposing sides of said mid-plane of said steering nozzle, and a bottom port located between said pivot axis and said outlet, said bottom port having a cross-sectional area greater than the cross-sectional area of either of said side ports.

20. The steering device as recited in claim 19, further comprising a reverse nozzle in flow communication with said bottom port.

21. A steering device comprising a steering nozzle, said steering nozzle in turn comprising first and second pivot means having a pivot axis lying in a mid-plane of said steering nozzle, an outlet remote from said pivot axis, first and second side ports located on opposing sides of said mid-plane of said steering nozzle, first and second side nozzles which communicate with said first and second side ports respectively, wherein each of said first and second side nozzles is substantially straight, and each of said first and second side nozzles is substantially perpendicular to said midplane.

* * * * *